US010789904B2

(12) United States Patent
Liu et al.

(10) Patent No.: US 10,789,904 B2
(45) Date of Patent: Sep. 29, 2020

(54) METHOD AND DEVICE FOR DRIVING DISPLAY PANEL AND DISPLAY DEVICE

(71) Applicants: HEFEI XINSHENG OPTOELECTRONICS TECHNOLOGY CO., LTD, Hefei (CN); BOE TECHNOLOGY GROUP CO., LTD., Beijing (CN)

(72) Inventors: Yuanyuan Liu, Beijing (CN); Shuai Liu, Beijing (CN); Xuanxuan Qiao, Beijing (CN); Xianfeng Yuan, Beijing (CN); Hongjun Wang, Beijing (CN); Kangxi Chen, Beijing (CN); Min Wang, Beijing (CN); Min Zhong, Beijing (CN)

(73) Assignees: HEFEI XINSHENG OPTOELECTRONICS TECHNOLOGY CO., LTD., Hefei, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/702,515

(22) Filed: Dec. 3, 2019

(65) Prior Publication Data

US 2020/0251063 A1 Aug. 6, 2020

(30) Foreign Application Priority Data

Jan. 31, 2019 (CN) ..... 2019 1 0106420

(51) Int. Cl.
*G09G 3/36* (2006.01)

(52) U.S. Cl.
CPC ..... *G09G 3/3614* (2013.01); *G09G 3/3696* (2013.01); *G09G 2310/08* (2013.01); *G09G 2330/10* (2013.01)

(58) Field of Classification Search
CPC .... G09G 3/006; G09G 3/3225; G09G 3/3291; G09G 2300/0819; G09G 2310/0297; G09G 2310/08; G09G 2320/0242; G09G 2320/0295; G09G 2330/10; H01L 27/3276
See application file for complete search history.

(56) References Cited

U.S. PATENT DOCUMENTS

2016/0019834 A1* 1/2016 Hall ..... G06F 1/1601 345/212
2019/0189038 A1* 6/2019 Park ..... G09G 3/3291

* cited by examiner

*Primary Examiner* — Nelson M Rosario
(74) *Attorney, Agent, or Firm* — Kinney & Lange, P.A.

(57) ABSTRACT

A method and a device for driving a display panel, and a display device are provided. The method includes: dividing the display panel into at least two display regions, where each display region corresponds to a timing controller, and the timing controller is configured to control the corresponding display region to display; dividing each display region into multiple detection blocks; detecting whether a defect block exists in each display region; and enabling, when the defect block exists in only one display region, by the timing controller corresponding to the only one display region, a pattern detection function, and enabling, when the defect block exists in each of more than one display region, by the timing controllers corresponding to the more than one display region simultaneously, the pattern detection function.

20 Claims, 3 Drawing Sheets

METHOD AND DEVICE FOR DRIVING DISPLAY PANEL AND DISPLAY DEVICE

CROSS-REFERENCE TO RELATED APPLICATION

This application claims a priority to Chinese Patent Application No. 201910106420.0 filed on Jan. 31, 2019, the disclosure of which is incorporated in its entirety by reference herein.

TECHNICAL FIELD

The present disclosure relates to the technical field of liquid crystal display device, and in particular to a method and a device for driving a display panel, and a display device.

BACKGROUND

With the continuous development of liquid crystal display technology, people's requirements on image quality of liquid crystal display panels are increasingly high. When evaluating image quality of a liquid crystal display panel, two important parameters, crosstalk and greenish, need to be considered. Due to existence of parasitic capacitance on the gate electrode of the liquid crystal display panel, when the gate electrode voltage is switched from the turn-on state to the turn-off state, the reference voltage of liquid crystal flipping is shifted, which causes the common electrode voltage to be pulled, resulting in the phenomenon of crosstalk or greenish in some special images.

SUMMARY

In an aspect, some embodiments of the present disclosure provide a method for driving a display panel, which includes: dividing the display panel into at least two display regions, where each of the at least two display regions corresponds to a timing controller, and the timing controller is configured to control the corresponding display region to display; dividing each of the at least two display regions into multiple detection blocks; detecting whether a defect block exists in each of the at least two display regions, where, when a preset pattern is displayed in a detection block of the multiple detection blocks, and the preset pattern meets a corresponding preset condition, the detection block is determined as the defect block; and enabling, when the defect block exists in only one display region of the at least two display regions, by the timing controller corresponding to the only one display region, a pattern detection function, and enabling, when the defect block exists in each of more than one display region of the at least two display regions, by the timing controllers corresponding to the more than one display region simultaneously, the pattern detection function.

In some embodiments, the pattern detection function includes changing a polarity of a display voltage; and the preset condition includes that: a ratio of an area occupied by pixels of the preset pattern in the detection block to an area of the detection block is greater than or equal to a first preset threshold, and among the pixels of the preset pattern, each of gray levels of at least a part of pixels of all pixels in a bright state is greater than or equal to a second preset threshold.

In some embodiments, the timing controllers include a master timing controller and a slave timing controller, one display region of the at least two display regions corresponds to the master timing control, and each of the rest of the at least two display regions corresponds to one slave timing controllers; the master timing controller is coupled to a system power and a system control signal; and the slave timing controller is coupled to the master timing controller, and the master timing controller is configured to provide an operating voltage for the slave timing controller.

In some embodiments, the determining whether a defect block exists in each of the at least two display regions; and enabling, when the defect block exists in only one display region of the at least two display regions, by the timing controller corresponding to the only one display region, a pattern detection function, and enabling, when the defect block exists in each of more than one display region of the at least two display regions, by the timing controllers corresponding to the more than one display region simultaneously, the pattern detection function, includes: detecting, by the master timing controller and the slave timing controller simultaneously, whether the defect block exists in the corresponding display regions; enabling, by the master timing controller, the pattern detection function, when the defect block is detected by the master timing controller and the defect block is not detected by the slave timing controller; enabling, by at least one slave timing controller, the pattern detection function, when the defect block is not detected by the master timing controller and the defect block is detected by the at least one slave timing controller; and enabling, by the master timing controller and at least one slave timing controller simultaneously, the pattern detection function, when the defect block is detected by both the master timing controller and the at least one slave timing controller.

In some embodiments, the enabling, by the master timing controller, the pattern detection function, when the defect block is detected by the master timing controller and the defect block is not detected by the slave timing controller, includes: setting, by the master timing controller, an action mode for the pattern detection function according to a type of the preset pattern in the defect block, when the defect block is detected by the master timing controller and the defect block is not detected by the slave timing controller; the enabling, by at least one slave timing controller, the pattern detection function, when the defect block is not detected by the master timing controller and the defect block is detected by the at least one slave timing controller, includes: setting, by the at least one slave timing controller, an action mode for the pattern detection function according to a type of the preset pattern in the defect block, when the defect block is not detected by the master timing controller and the defect block is detected by the at least one slave timing controller; and the enabling, by the master timing controller and at least one slave timing controller simultaneously, the pattern detection function, when the defect block is detected by both the master timing controller and the at least one slave timing controller, includes: when the defect block is detected by both the master timing controller and the at least one slave timing controller, and a type of the preset pattern in the defect block detected by the master timing controller is the same as a type of the preset pattern in the defect block detected by the at least one slave timing controller, selecting, by the master timing controller, an action mode of the pattern detection function according to the type of the preset pattern in the defect block, and sending the action mode of the pattern detection function and an enable signal to the at least one slave timing controller, so that the master timing controller and the at least one slave timing controller simultaneously set the action mode for the pattern detection function; and when the defect block is detected by both the master timing controller and the at least one slave timing controller, and a type of the preset pattern in the defect block detected by the master timing controller is different from a type of the preset pattern in the defect block detected by the at least one slave timing controller, selecting, by the master timing controller and the at least one slave timing controller respectively, action modes of the pattern detection function according to the types of the preset pattern in their respectively detected defect blocks, and sending, by the master timing controller, an enable signal to the at least one slave timing controller, so that the master timing controller and the at least one slave timing controller simultaneously set their respectively selected action modes for the pattern detection function.

In some embodiments, the preset condition is determined based on at least one of: a location of the detection block on the display panel, a size of the detection block, and a corresponding type of the preset pattern, or, luminance of a displayed image.

In some embodiments, the preset pattern has multiple types, and different types of the preset pattern correspond to different preset conditions.

In some embodiments, the at least a part of pixels are all pixels in the bright state among the pixels of the preset pattern.

In some embodiments, the first preset threshold is 20%.

In some embodiments, the second preset threshold is 64.

In some embodiments, the preset pattern has multiple types, and different types of the preset pattern correspond to different action modes.

In another aspect, some embodiments of the present disclosure provide a device for driving a display panel, which includes: a region dividing circuit, configured to divide the display panel into at least two display regions, where each of the at least two display regions corresponds to a timing controller, the timing controller is configured to control the corresponding display region to display, and the region dividing circuit is further configured to divide each of the at least two display regions into multiple detection blocks; and a detecting circuit, configured to detect whether a defect block exists in each of the at least two display regions, where, when a preset pattern is displayed in a detection block of the multiple detection blocks, and the preset pattern meets a corresponding preset condition, the detection block is determined as the defect block; where, when the defect block exists in only one display region of the at least two display regions, the timing controller corresponding to the only one display region enables a pattern detection function, and when the defect block exists in each of more than one display region of the at least two display regions, the timing controllers corresponding to the more than one display region simultaneously enable the pattern detection function.

In some embodiments, the pattern detection function includes changing a polarity of a display voltage; and the preset condition includes that: a ratio of an area occupied by pixels of the preset pattern in the detection block to an area of the detection block is greater than or equal to a first preset threshold, and among the pixels of the preset pattern, each of gray levels of at least a part of pixels of all pixels in a bright state is greater than or equal to a second preset threshold.

In some embodiments, the timing controllers include a master timing controller and a slave timing controller, one display region of the at least two display regions corresponds to the master timing control, and each of the rest of the at least two display regions corresponds to one slave timing controllers; the master timing controller is coupled to a system power and a system control signal; and the slave timing controller is coupled to the master timing controller, and the master timing controller is configured to provide an operating voltage for the slave timing controller.

In some embodiments, each of the master timing controller and the slave timing controller is provided with the detecting circuit; the detecting circuit of the master timing controller and the detecting circuit of the slave timing controller are configured to simultaneously detect whether the defect block exists in their corresponding display regions; when the defect block is detected by the master timing controller and the defect block is not detected by the slave timing controller, the master timing controller enables the pattern detection function; when the defect block is not detected by the master timing controller and the defect block is detected by at least one slave timing controller, the at least one slave timing controller enables the pattern detection function; and when the defect block is detected by both the master timing controller and at least one slave timing controller, the master timing controller and the at least one slave timing controller simultaneously enable the pattern detection function.

In some embodiments, when the defect block is detected by the master timing controller and the defect block is not detected by the slave timing controller, the master timing controller sets an action mode for the pattern detection function according to a type of the preset pattern in the defect block; when the defect block is not detected by the master timing controller and the defect block is detected by the at least one slave timing controller, the at least one slave timing controller sets an action mode for the pattern detection function according to a type of the preset pattern in the defect block; when the defect block is detected by both the master timing controller and the at least one slave timing controller, and a type of the preset pattern in the defect block detected by the master timing controller is the same as a type of the preset pattern in the defect block detected by the at least one slave timing controller, the master timing controller selects an action mode of the pattern detection function according to the type of the preset pattern in the defect block, and sends the action mode of the pattern detection function and an enable signal to the at least one slave timing controller, so that the master timing controller and the at least one slave timing controller simultaneously set the action mode for the pattern detection function; and when the defect block is detected by both the master timing controller and the at least one slave timing controller, and a type of the preset pattern in the defect block detected by the master timing controller is different from a type of the preset pattern in the defect block detected by the at least one slave timing controller, the master timing controller and the at least one slave timing controller respectively select action modes of the pattern detection function according to the types of the preset pattern in their respectively detected defect blocks, and the master timing controller sends an enable signal to the at least one slave timing controller, so that the master timing controller and the at least one slave timing controller simultaneously set their respectively selected action modes for the pattern detection function.

In some embodiments, the at least a part of pixels are all pixels in the bright state among the pixels of the preset pattern.

In some embodiments, the master timing controller is provided with a first communication circuit configured to transmit information of the pattern detection function, and the slave timing controller is provided with a second communication circuit configured to receive the information of the pattern detection function.

In still another aspect, some embodiments of the present disclosure provide a display device, which includes: a memory, configured to store a program; and a processor, configured to execute the program to implement the following steps: dividing a display panel into at least two display regions, where each of the at least two display regions corresponds to a timing controller, and the timing controller is configured to control the corresponding display region to display; dividing each of the at least two display regions into multiple detection blocks; detecting whether a defect block exists in each of the at least two display regions, where, when a preset pattern is displayed in a detection block of the multiple detection blocks, and the preset pattern meets a corresponding preset condition, the detection block is determined as the defect block; and enabling, when the defect block exists in only one display region of the at least two display regions, by the timing controller corresponding to the only one display region, a pattern detection function, and enabling, when the defect block exists in each of more than one display region of the at least two display regions, by the timing controllers corresponding to the more than one display region simultaneously, the pattern detection function.

In still another aspect, some embodiments of the present disclosure provide a computer readable storage medium having a program stored thereon, where, when the program is executed by a processor, steps of the method for driving the display panel as described above are performed.

BRIEF DESCRIPTION OF THE DRAWINGS

To better clarify technical solutions of embodiments of the present disclosure or the related technologies, drawings used in description of the embodiments or the related technologies are briefly introduced hereinafter. Apparently, the described drawings merely illustrate a part of the disclosed embodiments. A person ordinary skilled in the art can obtain other drawings based on the described drawings without any creative efforts.

DETAILED DESCRIPTION

The technical solutions in embodiments of the present disclosure are described clearly and completely in conjunction with drawings in the embodiments of the present disclosure. Apparently, the described embodiments are merely a part of rather than all the embodiments of the present disclosure. All other embodiments obtained by a person ordinary skilled in the art based on the embodiments of the present disclosure without any creative efforts fall within the protection scope of the present disclosure.

There is a parasitic capacitance on the gate electrode of the liquid crystal display panel. When the gate electrode voltage changes from the turn-on state to the turn-off state, the reference voltage of liquid crystal flipping is shifted, which causes the common electrode voltage to be pulled, resulting in the phenomenon of crosstalk or greenish in some special images.

In the related technologies, there are generally two methods for addressing the phenomena of crosstalk and greenish. The first method is reducing the resistance and capacitance loads of the data line/gate line, which usually requires adjustment of the wiring manner or process, such a method is difficult to implement and cost of adjustment is relatively high. The second method is detecting images with crosstalk and greenish via circuit, and using pattern detection function (PDF) to improve the images with crosstalk and greenish. The implementation manner of the PDF is that: pattern, gray level and ratio of an image to be detected are preset, and when a displayed image meets the preset condition, the phenomena of crosstalk and greenish are improved by changing polarity of pixel electrodes of the image. Such a method is simple and easy to implement, and has relatively low cost.

When the PDF is used to solve the phenomenon of crosstalk or green of the displayed image, the entire displayed image needs to be processed. Since the resolution of the liquid crystal display panel is getting higher and higher, a driving circuit having powerful functions is required correspondingly, and in particular, a main driving chip timing controller (TCON) corresponding to a liquid crystal display panel with a high refresh rate and a high resolution is required. However, the upgrade of TCON has not kept pace with the too rapid development of liquid crystal display panels, hence, corresponding TCONs are not available to many liquid crystal display panels with high refresh rate and high resolution in the related technologies. As a result, the phenomena of crosstalk and greenish of images of the liquid crystal display panel with high refresh rate and high resolution are difficult to process, resulting in relatively poor image quality.

Figure 1:
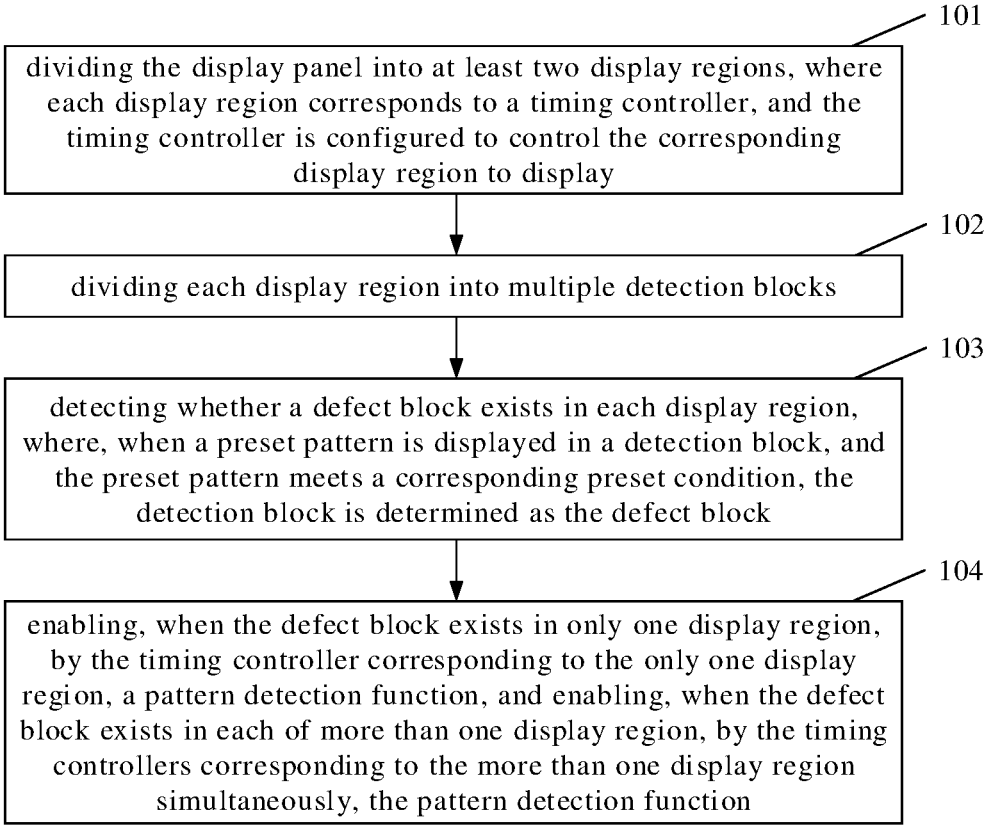
FIG. 1 is a flowchart of a method for driving a display panel according to some embodiments of the present disclosure.

In the related technologies, the phenomena of crosstalk and greenish of images of a display panel with a high refresh rate and a high resolution are difficult to process, resulting in relatively poor image quality. In view of the above, some embodiments of the present disclosure provide a method and a device for driving a display panel, and a display device. Some embodiments of the present disclosure provide a method for driving a display panel, as shown in FIG. 1, which may include steps 101 to 104.

Step 101: dividing the display panel into at least two display regions, where each of the at least two display regions corresponds to a timing controller, and the timing controller is configured to control the corresponding display region to display.

Figure 2:
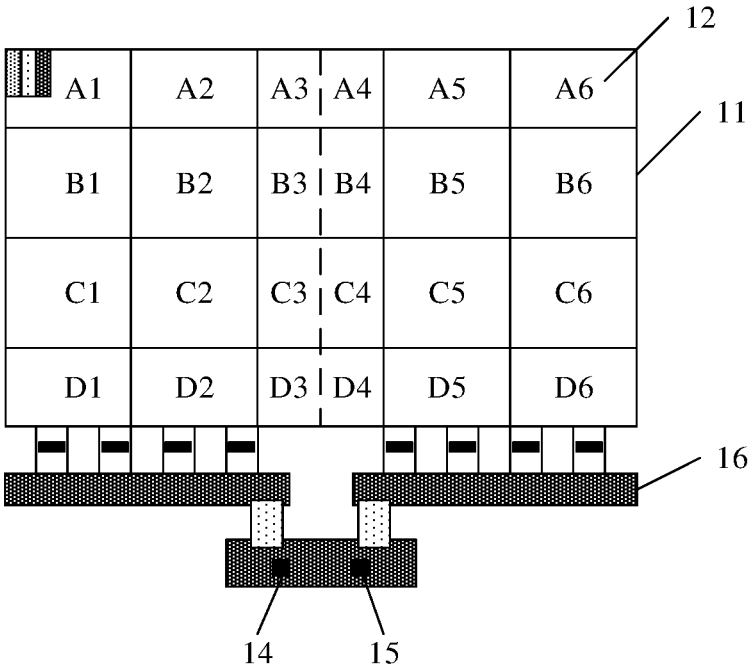
FIG. 2 is a schematic diagram of dividing regions of a display panel according to some embodiments of the present disclosure.

The specific number of the display regions is not limited in the embodiments of the present disclosure, and may be set by those skilled in the art according to actual conditions. For example, the display panel 11 may be divided into two display regions as shown in FIG. 2; or, the display panel 11 may be divided into three or four display regions. Each display region is controlled by a timing controller. In practical applications, the timing controller may be connected, via a signal, to the display region of the display panel 11 through an X-coordinate circuit board 16.

Step 102: dividing each of the at least two display regions into multiple detection blocks.

The specific number of the detection blocks is not limited by the embodiments of the present disclosure. For example, each display region may be divided into 4 or 8 detection blocks; or, as shown in FIG. 2, each display region may be divided into twelve detection blocks 12. It should be noted that, each detection block 12 may has a same or different size, which is not limited by the embodiments of the present disclosure.

Step 103: detecting whether a defect block exists in each of the at least two display regions, where, when a preset pattern is displayed in a detection block of the multiple detection blocks, and the preset pattern meets a corresponding preset condition, the detection block is determined as the defect block.

The preset condition may be set by those skilled in the art according to the actual situation, which is not limited by the embodiments of the present disclosure. In practical applications, the preset condition may be set by considering factors such as a location of the detection block on the display panel, a size of the detection block, a type of the preset pattern, or luminance of a displayed image.

For example, in some embodiments, the preset condition may include that: a ratio of an area occupied by pixels of the preset pattern in the detection block to an area of the detection block is greater than or equal to a first preset threshold, and among the pixels of the preset pattern, each of gray levels of at least a part of pixels of all pixels in a bright state is greater than or equal to a second preset threshold. The at least a part of pixels may be all pixels in the bright state among the pixels of the preset pattern.

It should be noted that, each detection block may correspond to a different preset condition. Specifically, the detection blocks at different locations of the display panel may correspond to different preset conditions. In practical applications, for the detection blocks at different locations, whether they are defect blocks may be determined according to their corresponding preset conditions.

The first preset threshold and the second preset threshold are preset values, which may be set by those skilled in the art according to actual conditions, and are not limited by the embodiments of the present disclosure. In practical applications, the first preset threshold and the second preset threshold may be set by considering factors such as a size of the detection block, a type of the preset pattern, or luminance of the displayed image. For example, the first preset threshold may be 20%; and the second preset threshold may be 64. For example, for a display with 256 gray levels, the second preset threshold may be 64; and for a display with other gray levels, the second preset threshold may be 25% of its maximum gray level.

Figure 3:
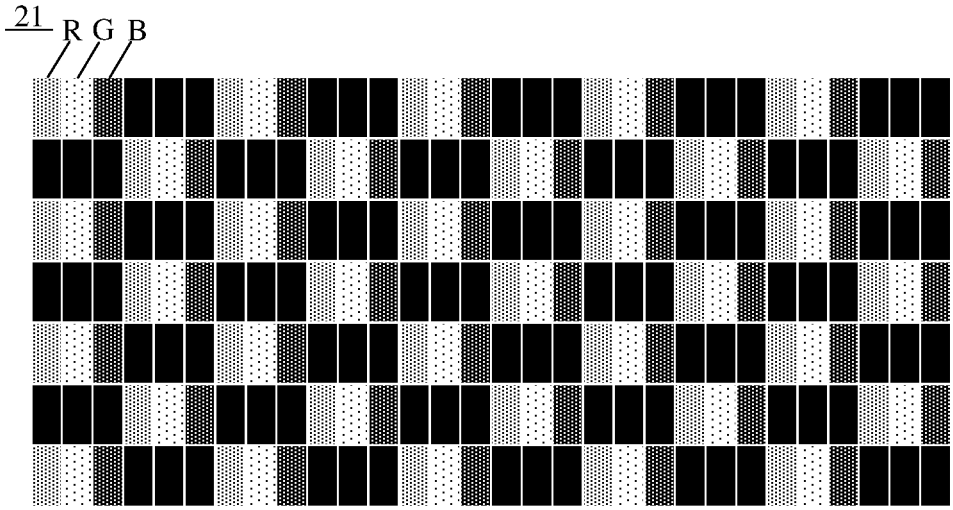
FIG. 3 is a schematic diagram of a preset pattern of Pixel On/Off according to some embodiments of the present disclosure.
Figure 4:
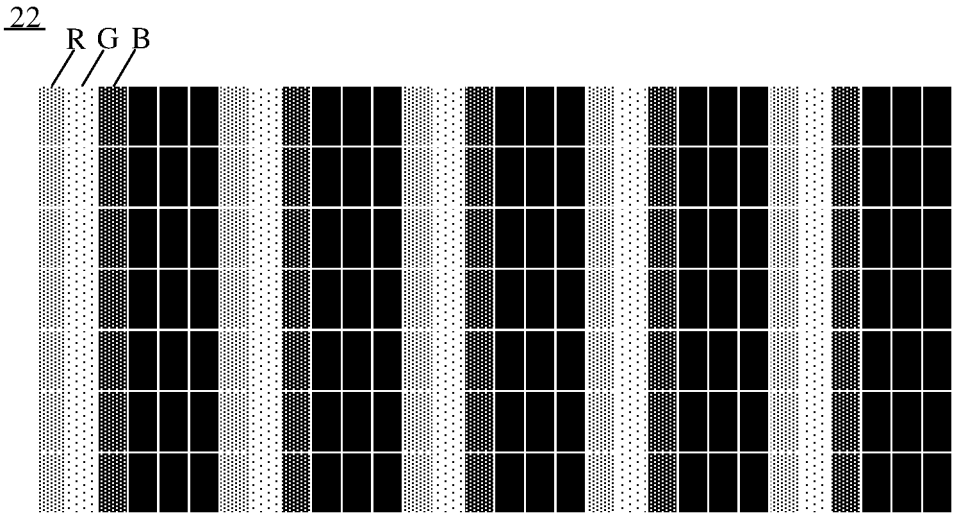
FIG. 4 is a schematic diagram of a preset pattern of Pixel One Line according to some embodiments of the present disclosure.

In practical applications, the preset pattern may have various types. For example, it may be a pattern 21 of Pixel On/Off as shown in FIG. 3, or a pattern 22 of Pixel One Line as shown in FIG. 4, or it may be other type of pattern. The preset pattern to be detected in the embodiments of the present disclosure may be a displayed image in which the phenomena of crosstalk and greenish are easy to occur.

In addition to the patterns of Pixel On/Off and Pixel One Line as shown in FIG. 3 and FIG. 4, the types of the preset pattern may be other patterns selected according to actual needs. For example, the preset pattern may be other displayed image obtained according to the theory or practice, in which the phenomena of crosstalk and crosstalk are easy to occur. The types of the preset pattern are not limited by the embodiments of the present disclosure.

It should be noted that, different types of the preset pattern may correspond to different preset conditions. For example, the first preset threshold and the second preset threshold corresponding to the pattern shown in FIG. 3 may be respectively different from the first preset threshold and the second preset threshold corresponding to the pattern shown in FIG. 4.

In the display panel, each pixel may include three subpixels of RGB. In the pattern 21 of Pixel On/Off shown in FIG. 3, pixels in a bright state and pixels in a dark state may be alternately arranged. In the pattern 22 of Pixel One Line shown in FIG. 4, pixel columns in a bright state and pixel columns in a dark state may be alternately arranged.

Figure 5:
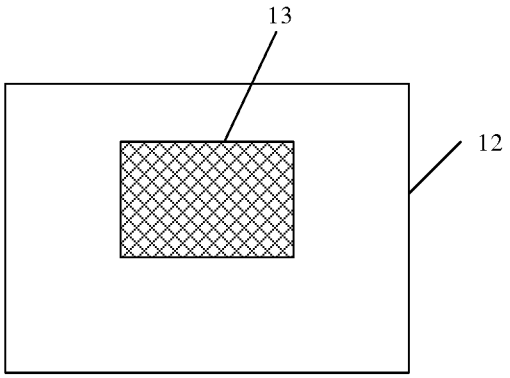
FIG. 5 is a schematic diagram of principle of determining a defect block according to some embodiments of the present disclosure.

Detection of whether there is a defect block in each display region is the detection of whether each detection block in each display region is a defect block. Since the types of the preset pattern have their own features (such as minimum repeating unit of the arranged pixels, or, color change of pixels in a same row or a same column, etc.), as shown in FIG. 5, the region 13 occupied by pixels of the identical preset pattern and its size (i.e., the area occupied by the pixels of the identical preset pattern) may be detected for each detection block 12 according to the above feature; and then, it is determined, according to the area occupied by the pixels of the identical preset pattern in the detection block and gray levels of pixels in a bright state among the pixels of the identical preset pattern, whether the detection block is a defect block.

Step 104: enabling, when the defect block exists in only one display region of the at least two display regions, by the timing controller corresponding to the only one display region, a pattern detection function, and enabling, when the defect block exists in each of more than one display region of the at least two display regions, by the timing controllers corresponding to the more than one display region simultaneously, the pattern detection function.

In some embodiments, the pattern detection function may include changing a polarity of a display voltage. For example, for a liquid crystal display panel, the display voltage may have two polarities: a positive polarity and a negative polarity; when the voltage of the pixel electrode is higher than the voltage of the common electrode, it is referred to as the positive polarity; and when the voltage of the pixel electrode is lower than the voltage of the common electrode, it is referred to as the negative polarity.

It should be noted that the multiple timing controllers may be divided into a master timing controller and multiple slave timing controllers, and the master timing controller may instruct the slave timing controllers to act together with it (i.e., simultaneously enabling the pattern detection function) via its intercommunication with the slave timing controllers; or, a master controller may be set, all the timing controllers may communicate with the master controller, and the master controller may indicate some or all of the timing controllers to enable the pattern detection function at the same time.

In this way, as compared with the related technologies, the display panel is divided in the embodiments of the present disclosure, each display region corresponds to a TCON with a low frequency and a low resolution, when the defect block exists in only one display region of the display panel, only the TCON for controlling the only one display region needs to enable the pattern detection function, and when the defect block exists in each of more than one display region of the display panel, the PDF functions of multiple TCONs are synchronized by simultaneously enabling the pattern detection functions. Therefore, the phenomena of crosstalk and greenish of the display panel with a high frequency and a high resolution are effectively improved, thereby improving the image quality.

As shown in FIG. 2, when the timing controllers include the master timing controller 14 and the slave timing controller 15, one display region of the at least two display regions corresponds to the master timing controller 14, and each of the rest of the displays regions corresponds to one slave timing controller 15. The master timing controller 14 is coupled to a system power and a system control signal; and the slave timing controller 15 is coupled to the master timing controller 14. The master timing controller 14 is configured to provide an operating voltage for the slave timing controller 15.

When detection is performed on the displayed image, the master timing controller 14 and the slave timing controller 15 simultaneously detect whether the defect block exists in the corresponding display regions; the master timing controller 14 enable the pattern detection function, when the defect block is detected by the master timing controller 14 and the defect block is not detected by the slave timing controller 15; at least one slave timing controller 15 enables the pattern detection function, when the defect block is not detected by the master timing controller 14 and the defect block is detected by the at least one slave timing controller 15; the master timing controller 14 and at least one slave timing controller 15 simultaneously enable the pattern detection function, when the defect block is detected by both the master timing controller 14 and the at least one slave timing controller 15.

In some embodiments, when the defect block is detected by the master timing controller 14 and the defect block is not detected by the slave timing controller 15, the master timing controller 14 sets an action mode for the pattern detection function according to a type of the preset pattern in the defect block; when the defect block is not detected by the master timing controller 14 and the defect block is detected by the at least one slave timing controller 15, the at least one slave timing controller 15 sets an action mode for the pattern detection function according to a type of the preset pattern in the defect block; when the defect block is detected by both the master timing controller 14 and the at least one slave timing controller 15, and a type of the preset pattern in the defect block detected by the master timing controller 14 is the same as a type of the preset pattern in the defect block detected by the at least one slave timing controller 15, the master timing controller 14 selects an action mode of the pattern detection function according to the type of the preset pattern in the defect block, and sends the action mode of the pattern detection function and an enable signal to the at least one slave timing controller 15, so that the master timing controller 14 and the at least one slave timing controller 15 simultaneously set the action mode for the pattern detection function; and when the defect block is detected by both the master timing controller 14 and the at least one slave timing controller 15, and a type of the preset pattern in the defect block detected by the master timing controller 14 is different from a type of the preset pattern in the defect block detected by the at least one slave timing controller 15, the master timing controller 14 and the at least one slave timing controller 15 respectively select action modes of the pattern detection function according to the types of the preset pattern in their respectively detected defect blocks, and the master timing controller 14 sends an enable signal to the at least one slave timing controller 15, so that the master timing controller 14 and the at least one slave timing controller 15 simultaneously set their respectively selected action modes for the pattern detection function.

It should be noted that, different types of the preset pattern may correspond to different action modes or correspond to the same action mode of the pattern detection function. In practical applications, a correspondence (such as a correspondence table) between the preset pattern and the action mode of the pattern detection function may be preset, and when the preset pattern is detected in the defect block, the corresponding action mode of the pattern detection function may be determined based on the correspondence (for example, by selecting from the correspondence table).

The action mode of the pattern detection function may include: inverting polarities of display voltages of N rows or columns or points in the display region where the defect block is located, where N is an integer greater than or equal to 1. The value of N may be set according to specifications of the display panel and actual needs.

It also should be noted that, when the master timing controller and the slave timing controller need to simultaneously enable the PDF function, each of the master timing controller and the slave timing controller needs to be provided with a communication function. To realize the communication function, the master timing controller and the slave timing controller each may be provided with a communication module (specifically, a communication circuit or a communication chip may be arranged inside each of the master timing controller and the slave timing controller), which is configured to transmit or receive action information of the PDF. First, the priority order is set, where the priority of the master timing controller is set to be higher than that of the slave timing controller, that is, the master timing controller and the slave timing controller detect simultaneously, and when the defect block is detected by both of them, the master timing controller determines the action mode of the PDF. The specific process may be as follows: after the defect block is detected, the master timing controller sends an inquiry message to the slave timing controller to inquire whether the defect block is detected by the slave timing controller, if not, it is a single-point trigger (i.e., only the master timing controller starts the PDF function), and for the case where the defect block is detected only by the slave timing controller, the process manner is similar; and if so, it is a multi-point trigger (i.e., the master timing controller and the slave timing controller need to start the PDF function at the same time), in which case the slave timing controller sends the detection information to the master timing controller, the master timing controller sends an instruction to the slave timing controller according to the preset action mode of the PDF after receiving the information, the slave timing controller returns a reception successful information after receiving the instruction, and the master timing controller and the slave timing controller simultaneously perform the PDF action.

For example, as shown in FIG. 2, the display panel 11 is divided into two display regions, that is, the display panel 11 is divided into a left half screen and a right half screen; the master timing controller (Master TCON) 14 controls the left half screen, specifically, detection blocks of A1~A3, B1~B3, C1~C3, and D1~D3; and the slave timing controller (Slave TCON) 15 controls the right half screen, specifically, detection blocks of A4~A6, B4~B6, C4~C6, and D4~D6. It should be noted that the number of the detection block is not limited to 24, and may be increased or decreased according to actual needs.

Figure 6:
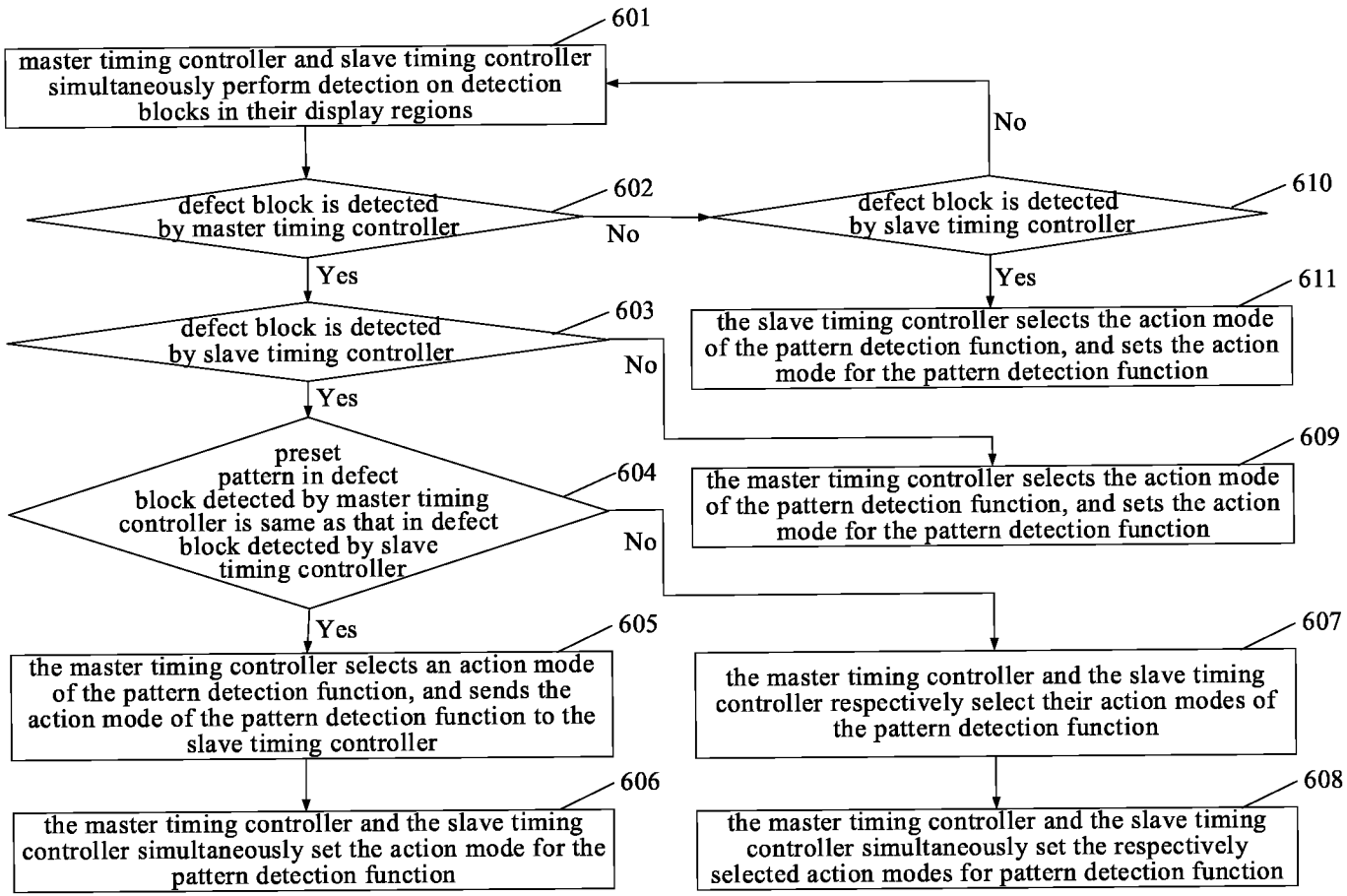
FIG. 6 is a flowchart of a method for driving a display panel according to some other embodiments of the present disclosure.

The specific method for detecting the displayed image on the display panel by the master timing controller 14 and the slave timing controller 15 may be as shown in FIG. 6, which may include steps 601 to 611.

Step 601: the master timing controller and the slave timing controller simultaneously perform detection on the detection blocks in their respectively controlled display regions.

Step 602: it is determined whether the defect block is detected by the master timing controller; if so, step 603 is performed; and if not, step 610 is performed.

Step 603: it is determined whether the defect block is detected by the slave timing controller; if so, step 604 is performed; and if not, step 609 is performed.

Step 604: it is determined whether the preset pattern displayed in the defect block detected by the master timing controller is the same as the preset pattern displayed in the defect block detected by the slave timing controller; if so, step 605 is performed, and if not, step 607 is performed.

When the defect block is detected by both the master timing controller and the slave timing controller, both the master timing controller and the slave timing controller need to enable the pattern detection function, and the master timing controller and the slave timing controller need to trigger simultaneously to ensure synchronized action.

Step 605: the master timing controller selects an action mode of the pattern detection function, and sends the action mode of the pattern detection function to the slave timing controller.

When the preset pattern of the defect block detected by the master timing controller is the same as the preset pattern of the defect block detected by the slave timing controller, the master timing controller selects the action mode of the pattern detection function according to the preset pattern of the defect block, and sends the action mode of the pattern detection function to the slave timing controller. For example, referring to FIG. 2 to FIG. 4, if the preset pattern of Pixel On/Off is only detected in the detection blocks of C3 and C4, the master timing controller and the slave timing controller need to act simultaneously and set the same action mode for the PDF; if the preset pattern of Pixel On/Off is detected in the detection blocks of B3 and B4, the preset pattern of Pixel One Line is detected in the detection blocks of D3 and D4, the master timing controller needs to select an appropriate action mode of the PDF according to the two types of preset pattern, and set the action mode for the PDF simultaneously with the slave timing controller.

Step 606: the master timing controller and the slave timing controller simultaneously set the action mode for the pattern detection function.

Step 607: the master timing controller and the slave timing controller respectively select their action modes of the pattern detection function.

When the preset pattern of the defect block detected by the master timing controller is different from the preset pattern of the defect block detected by the slave timing controller, the master timing controller and the slave timing controller may respectively select, based on the preset patterns of their respectively detected defect blocks, the action modes of the pattern detection function. For example, referring to FIG. 2 to FIG. 4, if the preset pattern of Pixel On/Off is detected in the detection block of B2, and the preset pattern of Pixel One Line is detected in the detection block of C4, the master timing controller and the slave timing controller may set different action modes for the PDF, but they need to act at the same time.

Step 608: the master timing controller and the slave timing controller simultaneously set the respectively selected action modes for pattern detection function.

Step 609: the master timing controller selects the action mode of the pattern detection function, and sets the action mode for the pattern detection function.

When the defect block is only detected by the master timing controller, the master timing controller may select the appropriate action mode of the pattern detection function according to the preset pattern of the detected defect block. For example, if the preset pattern of Pixel On/Off is detected in the detection block of B2 or in the detection blocks of C1 and C2, only the master timing controller needs to enable the pattern detection function.

Step 610: it is determined whether the defect block is detected by the slave timing controller; if so, step 611 is performed; and if not, step 601 is performed.

Step 611: the slave timing controller selects the action mode of the pattern detection function, and sets the action mode for the pattern detection function.

When the defect block is only detected by the slave timing controller, the slave timing controller may select the appropriate action mode of the pattern detection function according to the preset pattern of the detected defect block.

Some other embodiments of the present disclosure provide a device for driving a display panel, which includes:

a region dividing circuit, configured to divide the display panel into at least two display regions, where each of the at least two display regions corresponds to a timing controller, the timing controller is configured to control the corresponding display region to display, and the region dividing circuit is further configured to divide each of the at least two display regions into multiple detection blocks; and a detecting circuit, configured to detect whether a defect block exists in each of the at least two display regions, wherein, when a preset pattern is displayed in a detection block of the multiple detection blocks, and the preset pattern meets a corresponding preset condition, the detection block is determined as the defect block;

when the defect block exists in only one display region of the at least two display regions, the timing controller corresponding to the only one display region enables a pattern detection function, and when the defect block exists in each of more than one display region of the at least two display regions, the timing controllers corresponding to the more than one display region simultaneously enable the pattern detection function.

In some embodiments, the pattern detection function may include changing a polarity of a display voltage. In some embodiments, the preset condition may include that: a ratio of an area occupied by pixels of the preset pattern in the detection block to an area of the detection block is greater than or equal to a first preset threshold, and among the pixels of the preset pattern, each of gray levels of at least a part of pixels of all pixels in a bright state is greater than or equal to a second preset threshold. In some embodiments, the at least a part of pixels are all pixels in the bright state among the pixels of the preset pattern.

In some embodiments, the timing controllers include a master timing controller and a slave timing controller, one display region of the at least two display regions corresponds to the master timing control, and each of the rest of the at least two display regions corresponds to one slave timing controllers; the master timing controller is coupled to a system power and a system control signal; and the slave timing controller is coupled to the master timing controller, and the master timing controller is configured to provide an operating voltage for the slave timing controller.

In some embodiments, each of the master timing controller and the slave timing controller is provided with the detecting circuit; the detecting circuit of the master timing controller and the detecting circuit of the slave timing controller are configured to simultaneously detect whether the defect block exists in their corresponding display regions; when the defect block is detected by the master timing controller and the defect block is not detected by the slave timing controller, the master timing controller enables the pattern detection function; when the defect block is not detected by the master timing controller and the defect block is detected by at least one slave timing controller, the at least one slave timing controller enables the pattern detection function; and when the defect block is detected by both the master timing controller and at least one slave timing controller, the master timing controller and the at least one slave timing controller simultaneously enable the pattern detection function.

In some embodiments, when the defect block is detected by the master timing controller and the defect block is not detected by the slave timing controller, the master timing controller sets an action mode for the pattern detection function according to a type of the preset pattern in the defect block; when the defect block is not detected by the master timing controller and the defect block is detected by the at least one slave timing controller, the at least one slave timing controller sets an action mode for the pattern detection function according to a type of the preset pattern in the defect block; when the defect block is detected by both the master timing controller and the at least one slave timing controller, and a type of the preset pattern in the defect block detected by the master timing controller is the same as a type of the preset pattern in the defect block detected by the at least one slave timing controller, the master timing controller selects an action mode of the pattern detection function according to the type of the preset pattern in the defect block, and sends the action mode of the pattern detection function and an enable signal to the at least one slave timing controller, so that the master timing controller and the at least one slave timing controller simultaneously set the action mode for the pattern detection function; and when the defect block is detected by both the master timing controller and the at least one slave timing controller, and a type of the preset pattern in the defect block detected by the master timing controller is different from a type of the preset pattern in the defect block detected by the at least one slave timing controller, the master timing controller and the at least one slave timing controller respectively select action modes of the pattern detection function according to the types of the preset pattern in their respectively detected defect blocks, and the master timing controller sends an enable signal to the at least one slave timing controller, so that the master timing controller and the at least one slave timing controller simultaneously set their respectively selected action modes for the pattern detection function.

In some embodiments, the master timing controller is provided with a first communication circuit for transmitting information of the pattern detection function, and the slave timing controller is provided with a second communication circuit for receiving the information of the pattern detection function.

For the modules in the above device for driving the display panel, reference can be made to the introduction of the steps in the method for driving the display panel, which are not repeated herein, and the same functions as those of the method for driving the display panel can be realized.

Some embodiments of the present disclosure provide a display device, including: a memory, configured to store a computer program; and a processor, configured to execute the computer program to implement the method for driving the display panel as described above.

The display device may be any product or component having a display function, such as a mobile phone, a tablet computer, a television, a notebook computer, a digital photo frame, a navigator, and the like.

In the embodiments of the present disclosure, the display panel of the display device is divided, each display region corresponds to a TCON with a low frequency and a low resolution, when the defect block exists in only one display region of the display panel, only the TCON for controlling the only one display region needs to enable the pattern detection function, and when the defect block exists in each of more than one display region of the display panel, the PDF functions of multiple TCONs are synchronized by simultaneously enabling the pattern detection functions. Therefore, the phenomena of crosstalk and greenish of the display panel with a high frequency and a high resolution are effectively improved, thereby improving the image quality.

Some embodiments of the present disclosure further provide a computer readable storage medium having a program stored thereon, when the program is executed by a processor, the steps of the method for driving the display panel as described above are performed, and the same technical effect can be achieved, which is not repeated herein for simplicity. The computer readable storage medium may be a read-only memory (ROM), a random access memory (RAM), a magnetic disk, an optical disk, or the like.

Those of ordinary skill in the art will recognize that, the exemplary units and algorithm steps of the various embodiments described above may be implemented by electronic hardware, or by a combination of computer software and electronic hardware. Whether these functions are implemented by hardware or software depends on the specific application and design constraints of the solution. A skilled person may use different methods to implement the described functions for each particular application, and such implementations are not to be considered as departing from the scope of the present disclosure.

It should be understood that the device and method disclosed in the embodiments according to the present disclosure may be implemented by other ways. For example, the aforementioned device embodiments are merely exemplary, e.g., the units are merely divided in logical function, which may be divided in another way in actual implementation, such as multiple units or components may be combined or integrated into another system, or some features may be ignored or not performed. Furthermore, the shown or discussed mutual coupling or direct coupling or communication connection may be achieved by indirect coupling or communication connection through some interfaces, devices or units, which may be implemented in electric, mechanical or other forms.

The units described as separate components may be or not be physically separated, and the components displayed as units may be or may not be physical units, that is, may be located in one place, or may be distributed over multiple network units. Some or all of the units may be selected according to actual needs to realize the object of the solution of the embodiments. Additionally, the functional units in the various embodiments of the present disclosure may be integrated in one processing unit, or each unit may be physically present alone, or two or more units may be integrated in one unit.

For the implementation in the form of hardware, the processing unit may be implemented in one or more application specific integrated circuits (ASIC), digital signal processors (DSP), DSP devices (DSPD), programmable logic devices (PLD), field-programmable gate arrays (FPGA), general purpose processors, controllers, microcontrollers, microprocessors, other electronic units for performing the functions described in the present disclosure or a combination thereof.

If the functions are implemented in the form of software functional units, and sold or used as a standalone product, they may be stored in a computer readable storage medium. Based on this understanding, essence of the technical solution of the present disclosure, or the part contributing to the conventional technologies, or part of the technical solution, can be embodied in the form of a software product. The computer software product is stored in a storage medium, and the computer software product includes a number of instructions for enabling a computer device (which may be a personal computer, a server, a network device or the like) to execute all or part of the steps of the method described in the various embodiments of the present disclosure. The storage medium may include a USB flash disk, a mobile hard disk, a read-only memory (ROM), a random access memory (RAM), a magnetic disk, an optical disk, and other medium which can store program code.

The aforementioned are merely specific implementations of the present disclosure, and the protection scope of the present disclosure is not limited thereto. Any modifications or replacements that would easily occur to those skilled in the art, without departing from the technical scope disclosed in the present disclosure, should be encompassed in the protection scope of the present disclosure. Therefore, the protection scope of the present disclosure is to be determined by the protection scope of the claims.

What is claimed is:

1. A method for driving a display panel, comprising:

dividing the display panel into at least two display regions, wherein each of the at least two display regions corresponds to a timing controller, and the timing controller is configured to control the corresponding display region to display;

dividing each of the at least two display regions into a plurality of detection blocks;

detecting whether a defect block exists in each of the at least two display regions, wherein, when a preset pattern is displayed in a detection block of the plurality of detection blocks, and the preset pattern meets a corresponding preset condition, the detection block is determined as the defect block; and enabling, when the defect block exists in only one display region of the at least two display regions, by the timing controller corresponding to the only one display region, a pattern detection function, and enabling, when the defect block exists in each of more than one display region of the at least two display regions, by the timing controllers corresponding to the more than one display region simultaneously, the pattern detection function.

2. The method for driving the display panel according to claim 1, wherein:

the pattern detection function comprises changing a polarity of a display voltage; and the preset condition comprises that: a ratio of an area occupied by pixels of the preset pattern in the detection block to an area of the detection block is greater than or equal to a first preset threshold, and among the pixels of the preset pattern, each of gray levels of at least a part of pixels of all pixels in a bright state is greater than or equal to a second preset threshold.

3. The method for driving the display panel according to claim 1, wherein the timing controllers comprise a master timing controller and a slave timing controller, one display region of the at least two display regions corresponds to the master timing control, and each of the rest of the at least two display regions corresponds to one slave timing controller;

the master timing controller is coupled to a system power and a system control signal; and the slave timing controller is coupled to the master timing controller, and the master timing controller is configured to provide an operating voltage for the slave timing controller.

4. The method for driving the display panel according to claim 3, wherein the steps of determining whether a defect block exists in each of the at least two display regions; enabling, when the defect block exists in only one display region of the at least two display regions, by the timing controller corresponding to the only one display region, a pattern detection function; and enabling, when the defect block exists in each of more than one display region of the at least two display regions, by the timing controllers corresponding to the more than one display region simultaneously, the pattern detection function, comprises:

detecting, by the master timing controller and the slave timing controller simultaneously, whether the defect block exists in the corresponding display regions;

enabling, by the master timing controller, the pattern detection function, when the defect block is detected by the master timing controller and the defect block is not detected by the slave timing controller;

enabling, by at least one slave timing controller, the pattern detection function, when the defect block is not detected by the master timing controller and the defect block is detected by the at least one slave timing controller; and enabling, by the master timing controller and at least one slave timing controller simultaneously, the pattern detection function, when the defect block is detected by both the master timing controller and the at least one slave timing controller.

5. The method for driving the display panel according to claim 4, wherein:

the enabling, by the master timing controller, the pattern detection function, when the defect block is detected by the master timing controller and the defect block is not detected by the slave timing controller, comprises: setting, by the master timing controller, an action mode for the pattern detection function according to a type of the preset pattern in the defect block, when the defect block is detected by the master timing controller and the defect block is not detected by the slave timing controller;

the enabling, by at least one slave timing controller, the pattern detection function, when the defect block is not detected by the master timing controller and the defect block is detected by the at least one slave timing controller, comprises: setting, by the at least one slave timing controller, an action mode for the pattern detection function according to a type of the preset pattern in the defect block, when the defect block is not detected by the master timing controller and the defect block is detected by the at least one slave timing controller; and the enabling, by the master timing controller and at least one slave timing controller simultaneously, the pattern detection function, when the defect block is detected by both the master timing controller and the at least one slave timing controller, comprises:

when the defect block is detected by both the master timing controller and the at least one slave timing controller, and a type of the preset pattern in the defect block detected by the master timing controller is the same as a type of the preset pattern in the defect block detected by the at least one slave timing controller, selecting, by the master timing controller, an action mode of the pattern detection function according to the type of the preset pattern in the defect block, and sending the action mode of the pattern detection function and an enable signal to the at least one slave timing controller, so that the master timing controller and the at least one slave timing controller simultaneously set the action mode for the pattern detection function; and when the defect block is detected by both the master timing controller and the at least one slave timing controller, and a type of the preset pattern in the defect block detected by the master timing controller is different from a type of the preset pattern in the defect block detected by the at least one slave timing controller, selecting, by the master timing controller and the at least one slave timing controller respectively, action modes of the pattern detection function according to the types of the preset pattern in their respectively detected defect blocks, and sending, by the master timing controller, an enable signal to the at least one slave timing controller, so that the master timing controller and the at least one slave timing controller simultaneously set their respectively selected action modes for the pattern detection function.

6. The method for driving the display panel according to claim 1, wherein the preset condition is determined based on at least one of: a location of the detection block on the display panel, a size of the detection block, and a corresponding type of the preset pattern, or luminance of a displayed image.

7. The method for driving the display panel according to claim 1, wherein the preset pattern has a plurality of types, and different types of the preset pattern correspond to different preset conditions.

8. The method for driving the display panel according to claim 2, wherein the at least a part of pixels are all pixels in the bright state among the pixels of the preset pattern.

9. The method for driving the display panel according to claim 2, wherein the first preset threshold is 20%.

10. The method for driving the display panel according to claim 2, wherein the second preset threshold is 64.

11. The method for driving the display panel according to claim 5, wherein the preset pattern has a plurality of types, and different types of the preset pattern correspond to different action modes.

12. A device for driving a display panel, comprising:

a region dividing circuit, configured to divide the display panel into at least two display regions, wherein each of the at least two display regions corresponds to a timing controller, the timing controller is configured to control the corresponding display region to display, and the region dividing circuit is further configured to divide each of the at least two display regions into a plurality of detection blocks; and a detecting circuit, configured to detect whether a defect block exists in each of the at least two display regions, wherein, when a preset pattern is displayed in a detection block of the plurality of detection blocks, and the preset pattern meets a corresponding preset condition, the detection block is determined as the defect block;

wherein, when the defect block exists in only one display region of the at least two display regions, the timing controller corresponding to the only one display region enables a pattern detection function, and when the defect block exists in each of more than one display region of the at least two display regions, the timing controllers corresponding to the more than one display region simultaneously enable the pattern detection function.

13. The device for driving the display panel according to claim 12, wherein:

the pattern detection function comprises changing a polarity of a display voltage; and the preset condition comprises that: a ratio of an area occupied by pixels of the preset pattern in the detection block to an area of the detection block is greater than or equal to a first preset threshold, and among the pixels of the preset pattern, each of gray levels of at least a part of pixels of all pixels in a bright state is greater than or equal to a second preset threshold.

14. The device for driving the display panel according to claim 12, wherein:

the timing controllers comprise a master timing controller and a slave timing controller, one display region of the at least two display regions corresponds to the master timing control, and each of the rest of the at least two display regions corresponds to one slave timing controllers;

the master timing controller is coupled to a system power and a system control signal; and the slave timing controller is coupled to the master timing controller, and the master timing controller is configured to provide an operating voltage for the slave timing controller.

15. The device for driving the display panel according to claim 14, wherein:

each of the master timing controller and the slave timing controller is provided with the detecting circuit;

the detecting circuit of the master timing controller and the detecting circuit of the slave timing controller are configured to simultaneously detect whether the defect block exists in their corresponding display regions;

in response to the defect block being detected by the master timing controller and the defect block not being detected by the slave timing controller, the master timing controller enables the pattern detection function;

in response to the defect block not being detected by the master timing controller and the defect block being detected by at least one slave timing controller, the at least one slave timing controller enables the pattern detection function; and in response to the defect block being detected by both the master timing controller and at least one slave timing controller, the master timing controller and the at least one slave timing controller simultaneously enable the pattern detection function.

16. The device for driving the display panel according to claim 15, wherein, in response to the defect block being detected by the master timing controller and the defect block not being detected by the slave timing controller, the master timing controller sets an action mode for the pattern detection function according to a type of the preset pattern in the defect block;

in response to the defect block not being detected by the master timing controller and the defect block being detected by the at least one slave timing controller, the at least one slave timing controller sets an action mode for the pattern detection function according to a type of the preset pattern in the defect block;

in response to the defect block being detected by both the master timing controller and the at least one slave timing controller, and a type of the preset pattern in the defect block detected by the master timing controller being the same as a type of the preset pattern in the defect block detected by the at least one slave timing controller, the master timing controller selects an action mode of the pattern detection function according to the type of the preset pattern in the defect block, and sends the action mode of the pattern detection function and an enable signal to the at least one slave timing controller, so that the master timing controller and the at least one slave timing controller simultaneously set the action mode for the pattern detection function; and in response to the defect block being detected by both the master timing controller and the at least one slave timing controller, and a type of the preset pattern in the defect block detected by the master timing controller being different from a type of the preset pattern in the defect block detected by the at least one slave timing controller, the master timing controller and the at least one slave timing controller respectively select action modes of the pattern detection function according to the types of the preset pattern in their respectively detected defect blocks, and the master timing controller sends an enable signal to the at least one slave timing controller, so that the master timing controller and the at least one slave timing controller simultaneously set their respectively selected action modes for the pattern detection function.

17. The device for driving the display panel according to claim 13, wherein the at least a part of pixels are all pixels in the bright state among the pixels of the preset pattern.

18. The device for driving the display panel according to claim 14, wherein the master timing controller is provided with a first communication circuit configured to transmit information of the pattern detection function, and the slave timing controller is provided with a second communication circuit configured to receive the information of the pattern detection function.

19. A display device, comprising:

a memory, configured to store a program; and a processor, configured to execute the program to implement the following steps:

dividing a display panel into at least two display regions, wherein each of the at least two display regions corresponds to a timing controller, and the timing controller is configured to control the corresponding display region to display;

dividing each of the at least two display regions into a plurality of detection blocks;

detecting whether a defect block exists in each of the at least two display regions, wherein, when a preset pattern is displayed in a detection block of the plurality of detection blocks, and the preset pattern meets a corresponding preset condition, the detection block is determined as the defect block; and enabling, when the defect block exists in only one display region of the at least two display regions, by the timing controller corresponding to the only one display region, a pattern detection function, and enabling, when the defect block exists in each of more than one display region of the at least two display regions, by the timing controllers corresponding to the more than one display region simultaneously, the pattern detection function.

20. A non-transitory computer readable storage medium, having a program stored thereon, the program, when executed by a processor, performing the steps of the method for driving the display panel according to claim 1.

* * * * *